United States Patent [19]

Watanabe

[11] Patent Number: 5,040,508

[45] Date of Patent: Aug. 20, 1991

[54] THROTTLE VALVE ACTUATOR

[75] Inventor: Shunso F. Watanabe, Livonia, Mich.

[73] Assignee: Ford Motor Company, Dearborn, Mich.

[21] Appl. No.: 434,950

[22] Filed: Nov. 9, 1989

[51] Int. Cl.[5] ..... F02D 11/04; F02D 11/10

[52] U.S. Cl. ..... 123/396; 123/399; 123/400; 475/4

[58] Field of Search ..... 123/399, 396, 400, 361, 123/403; 475/4

[56] References Cited

U.S. PATENT DOCUMENTS

| | | | |
|---|---|---|---|
| 2,987,056 | 6/1961 | Catford et al. | 123/367 |
| 3,099,330 | 7/1963 | Von Berg et al. | 123/350 |
| 4,163,432 | 8/1979 | Hertifelder | 123/361 |
| 4,245,599 | 1/1981 | Des Lauriers | 123/353 |
| 4,380,799 | 4/1983 | Allard et al. | 364/426 |
| 4,424,785 | 1/1984 | Ishida et al. | 123/399 |
| 4,455,978 | 6/1984 | Atago et al. | 123/339 |
| 4,526,060 | 7/1985 | Watanabe | 74/626 |
| 4,702,208 | 10/1987 | Lombard et al. | 123/361 |
| 4,809,656 | 3/1989 | Suzuki | 123/399 |
| 4,873,957 | 10/1989 | Ueyama et al. | 123/399 |
| 4,895,343 | 1/1990 | Sato | 123/399 |

FOREIGN PATENT DOCUMENTS

| | | | |
|---|---|---|---|
| 59-153945 | 9/1984 | Japan | 123/361 |
| 63-150438 | 6/1988 | Japan | 123/399 |

*Primary Examiner*—Andrew M. Dolinar

*Attorney, Agent, or Firm*—Jerome R. Drouillard; Clifford L. Sadler

[57] ABSTRACT

A throttle valve actuator is provided for connecting a throttle valve of a motor vehicle to the accelerator pedal in either a direct or remote drive mode. A coupling mechanism is provided for coupling and uncoupling a throttle valve to the accelerator pedal linkage and a specified relative orientation in response to a control signal. The coupling mechanism includes a drive element coupled to the accelerator pedal, a driven element coupled to the throttle valve and a control element cooperating with the drive and driven elements. A remotely operable stop is provided to fix the control element in a specified position directly coupling the accelerator pedal to the throttle valve when in the direct drive mode and releasing the control element, when in the remote drive mode. The remote drive mechanism automatically positions the throttle valve when the control element is free when in the remote drive mode.

20 Claims, 4 Drawing Sheets

THROTTLE VALVE ACTUATOR

TECHNICAL FIELD

This invention relates in general to motor vehicle throttle valve actuators. More particularly, the invention relates to an actuator for connecting the throttle valve of the motor vehicle to the vehicle accelerator pedal in either a direct drive or a remote drive mode.

BACKGROUND ART

There is growing interest in the auto industry in controlling the position of the throttle valve using an electronic engine controller so as to optimize fuel consumption and engine performance. Vehicles employing a remotely operable throttle directly coupled to the vehicle accelerator pedal are frequently referred to as having drive-by-wire systems. The engine controller regulates the throttle position based on a number of inputs such as accelerator pedal position, engine speed, manifold pressure, etc. There are times, however, when it is desirable to reconnect the throttle valve to the accelerator pedal so that the throttle may be moved in a direct drive mode. A number of devices are known in the prior art for regulating the throttle position automatically using an electronic engine controller. U.S. Pat. No. 4,163,432, Hertfelder, discloses an electrically driven throttle actuator which is connected to the accelerator pedal via a releasable electric clutch. The throttle valve and accelerator pedal always remain mechanically coupled to one another.

U.S. Pat. No. 4,245,599, Des Laurres, relates to a vehicle idle speed control system having an adjustable throttle stop for idle speed control. The accelerator pedal always remains mechanically connected to the throttle valve.

U.S. Pat. No. 4,380,799, Allard, discloses a computer-based throttle position control mechanism. A mechanical linkage connects the accelerator pedal to the carburetor throttle valve. The effective length of the mechanical linkage may be varied by a servomotor, thereby regulating the throttle position.

U.S. Pat. No. 4,455,978, Atago, relates to an engine speed control system which employs an electric motor-driven stop so that the idle speed of the engine may be controlled.

U.S. Pat. No. 4,526,060, Watanabe, discloses an earlier system of the present inventor utilizing a throttle valve actuator providing a stop moved within two ranges to provide both idle speed control and vehicle speed control. During both modes the accelerator pedal remains constantly mechanically coupled to the throttle valve.

A feature of the present throttle valve actuator is its ability to automatically couple and uncouple the throttle valve from the accelerator pedal linkage in a specified relative orientation in response to a coupling signal so that the throttle may be controlled in either the remote drive or the direct drive mode.

Another feature of the present invention is that it provides a compact, reliable, cost-efficient throttle valve actuator suitable for use in the production of automobiles.

These and other features and advantages of the invention will be apparent upon further review of the description of the preferred embodiment.

DISCLOSURE OF THE INVENTION

Accordingly, a motor vehicle throttle valve actuator for the present invention, which can be used for connecting the throttle valve of a vehicle to the accelerator pedal linkage in either the direct drive or remote drive mode, includes an automatic coupling mechanism for coupling and uncoupling the throttle valve to the accelerator pedal linkage in a specified relative orientation in response to a coupling signal. The throttle valve actuator additionally includes a remote drive mechanism to automatically position the throttle valve when uncoupled from the accelerator pedal linkage.

The invention additionally includes a method of automatically regulating the position of the throttle valve in a motor vehicle engine. The method includes the steps of providing a throttle valve actuator having a driven member fixed to a throttle valve, a drive member fixed to the accelerator pedal of the vehicle and a control member engaged with the drive and driven members. When the control member is free, the throttle valve and accelerator pedal are free to move relative to one another in an uncoupled mode. When the control members move to a fixed position, the drive and driven members become coupled relative to one another in a predetermined relative orientation. An electronic engine controller is provided for controlling the throttle motor, which is coupled to the throttle valve. The position of the throttle valve is automatically regulated using the throttle motor when the control member is in the uncoupled mode. Shifting the control member to its fixed position manually couples the accelerator pedal and throttle valve thereby allowing the manual regulation of the throttle valve using the accelerator pedal.

BEST MODES FOR CARRYING OUT THE INVENTION

Figure 1:
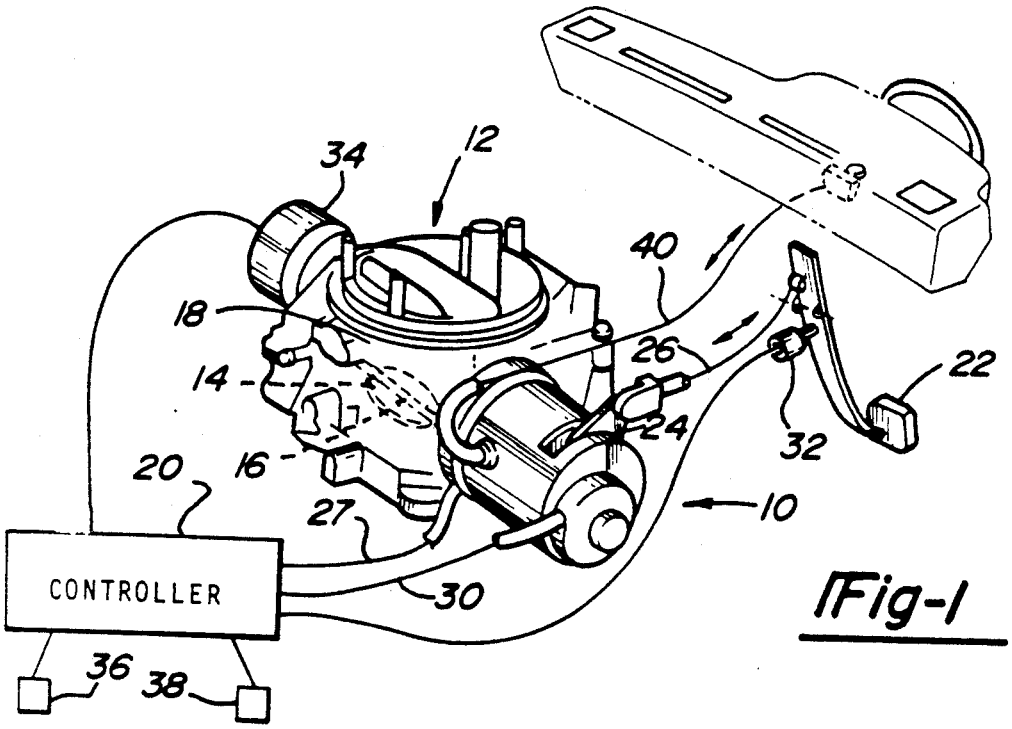
FIG. 1 is a schematic illustration of a throttle valve actuator in the environment of a motor vehicle.
Figure 2:
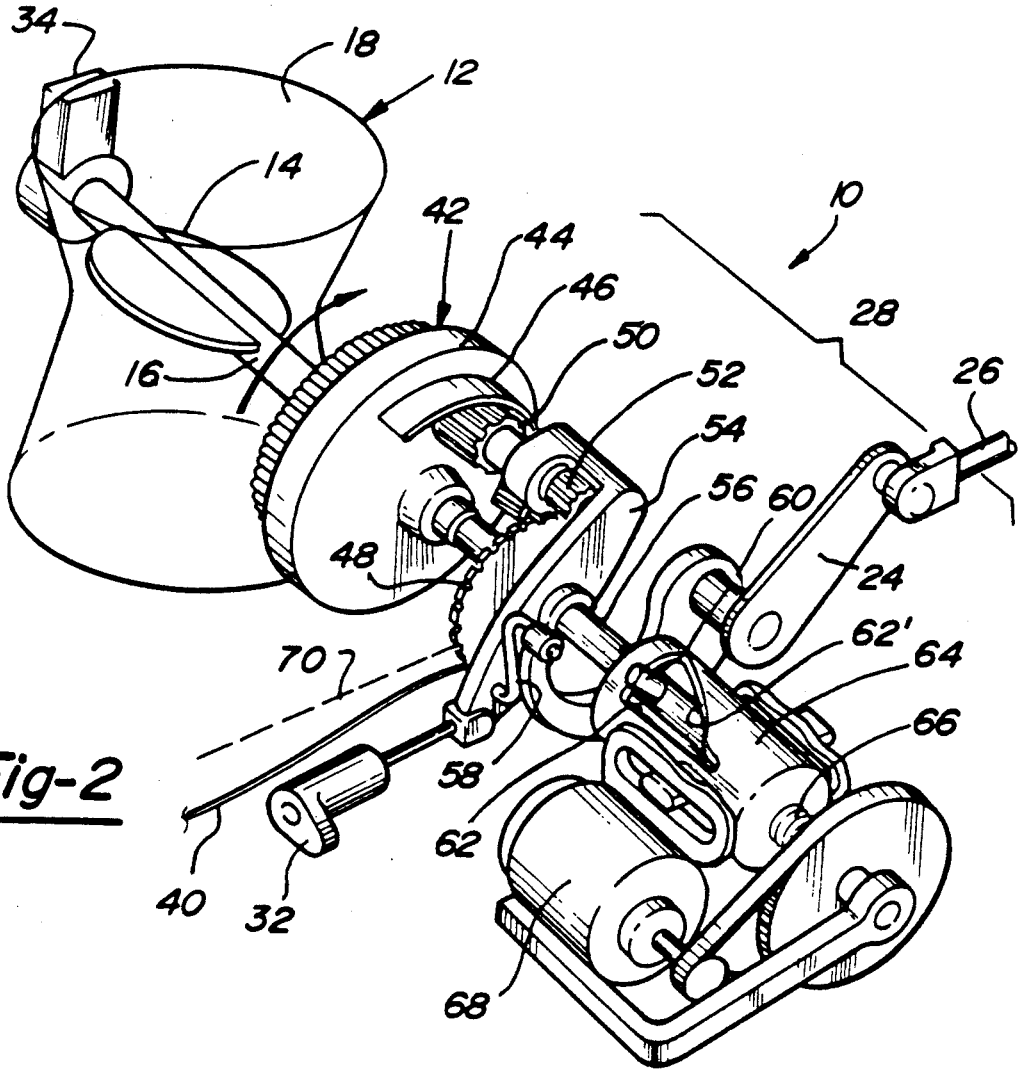
FIG. 2 is a simplified perspective view which has been enlarged to better illustrate the preferred embodiment of the invention.

Referring to FIGS. 1 and 2 of the drawings, a perspective view of a throttle valve actuator 10 fixed to a throttle body assembly 12 is shown. A butterfly-type throttle valve 14 is affixed to throttle shaft 16 which is rotatable relative to the throttle body to regulate the flow of air through a throttle bore 18. The position of throttle valve 14 within the bore is controlled by the throttle valve actuator 10 which is coupled to throttle shaft 16. The throttle valve actuator 10 allows the position of the throttle to be regulated in either a direct drive mode or in a remote drive mode.

In the remote drive mode the position of the throttle valve is controlled by an electronic engine controller 20. In the direct drive mode the position of the throttle valve is controlled directly by the accelerator pedal 22 positioned by the vehicle operator. The throttle valve actuator 10 is provided with an accelerator input lever 24 which is connected to the accelerator pedal 22 via an accelerator linkage 26.

In the remote drive mode, throttle position is controlled by an electronic engine controller, without any direct mechanical connection between the accelerator pedal and throttle valve. Electronic engine controller 20 provides throttle position input 27 to motor 42 and a mode control input 30 to coupling motor, 68, within the coupling assembly 28. The throttle valve position signal enables motor 42 to regulate the position of the throttle valve when operating in the remote drive mode. The mode control signal enables the coupling assembly 28 to automatically shift between the direct drive and the remote drive modes. Electronic engine controller 20 varies the throttle position signal and mode control signal based upon various inputs supplied by accelerator pedal position sensor 32, throttle valve position sensor 34, engine speed sensor 36, manifold pressure sensor 38, or various other inputs relating to vehicle operating parameters.

In addition to coupling assembly 28 which provides a means for automatically coupling and uncoupling the throttle valve to the accelerator pedal linkage, the throttle valve actuator may be provided with a manual coupling means for coupling the accelerator pedal to the throttle valve in response to a mechanical override signal. Cable 40 provides a mechanical linkage to the throttle valve actuator 10 to enable the vehicle occupant to manually couple the throttle valve to the accelerator pedal without any electrical actuation in the event of an electrical malfunction.

Figure 3:
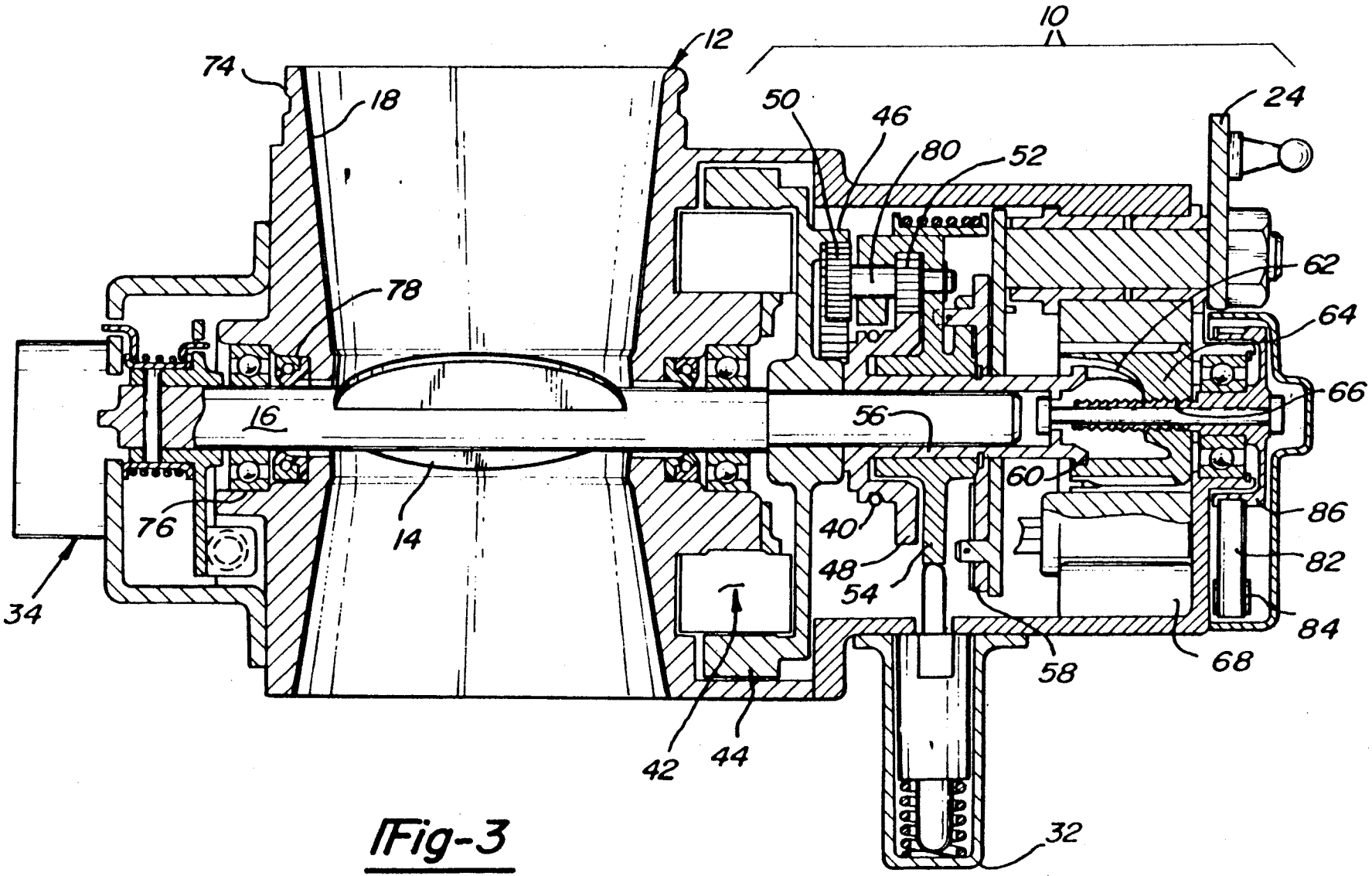
FIG. 3 is a cross-sectional side elevation of the preferred embodiment of the invention.

FIG. 3 shows a cross-sectional side elevation of a compact throttle valve actuator 10 affixed to a throttle body assembly 12 representative of a commercial design equivalent to the structure illustrated in FIG. 2. Coupling assembly 28 includes a drive element connected to the vehicle throttle linkage, a driven element connected to the throttle valve and a control element constantly cooperating with drive and driven elements. When the control element is free, the drive and driven elements move independently of one another. When the control element is moved to a predetermined fixed orientation, the movement of the drive and driven elements is directly interrelated. In the direct drive mode the movement of throttle valve is controlled by a motor 42. Motor 42 serves as a remote drive mechanism for automatically positioning the throttle when the throttle valve actuator is in the remote drive mode. Throttle position input 27 controls the operation of motor 42. Motor 42 is provided with a rotor 44 which is affixed to throttle shaft 16 for rotation therewith.

In the preferred embodiment of the invention shown, the driven element, the drive element and the control element comprise the ring gear, planet carrier of a planetary gear set. The ring, sun and planet carrier are pivotably orientated about a common axis. The planet gears which are pivotably supported by the planet carrier rotated about an axis spaced apart and parallel to the planetary gears axis and rotate thereabout while engagement with the sun and ring gear in a conventional manner. Affixed to rotor 44 is a ring gear segment 46 which makes up part of a planetary gear set. Sun gear 48, planet gears 50 and 52, and planet carrier 54 make up the remaining elements of the planetary gear set. The planetary gear set has an axis coaxially aligned with throttle shaft 16. Sun gear 48 is provided with a hub 56 which rotatably engages and is supported by throttle shaft 16. Planet carrier 54 rides upon sun gear hub 56 and is free to rotate relative thereto. The planet carrier 54 provides a drive element which is coupled to the accelerator pedal input lever by a link 58. Movement of the accelerator pedal 22 by the vehicle driver causes the accelerator pedal input lever 24 and planet 52 to move rotating the planet carrier 54 about the throttle valve axis.

In the remote drive mode, illustrated in FIG. 2, sun gear 48 is free to rotate about the throttle shaft axis within a limited range. When the sun gear is free, the planet carrier 54 is able to rotate independently of ring gear 46. In the remote drive mode, when the sun gear is free, the throttle valve is positioned by motor 42. Movement of the accelerator pedal in the remote drive mode causes a planet carrier to move; however, the planet gears do not transmit force to the ring gear since they and the sun gear 48 are free to rotate about their respective axis.

Sun gear hub 56 is provided with a tang 60 which cooperates with cam surfaces 62 and 62' in moveable stop 64. Cam surfaces 62 and 62' formed in moveable stop 64 are circumaxially spaced from one another by a distance which varies as a function of axial position along the length of the stop. Stop 64 is shifted axially by a screw 66 which is rotated by motor 68. When the stop is in the remote drive position, as shown, tang 60 on the sun gear hub 56 is able to freely rotate approximately 90 degrees, thereby enabling the throttle to be moved between the closed and wide open positions. When it is desired to automatically enter the direct drive mode, recoupling the throttle valve to the accelerator pedal, motor 68 rotates screw 66 advancing the moveable stop 64 axially. As stop 64 advances relative to tang 60 on the sun gear hub, the sun gear is rotated to a predetermined fixed position and held securely in place. With the sun gear fixed, the movement of the planet carrier and the ring gear becomes interdependent.

When the sun gear is held in its fixed position by the stop, the accelerator pedal becomes directly linked to the throttle valve in proper relative alignment; i.e., if the accelerator pedal is at the wide open throttle position, rotating the sun gear to the fixed position will cause the throttle valve to move to the wide open position. Similarly, if the accelerator pedal is at the idle position, rotating the sun gear to the fixed position will cause the throttle valve to move to the idle position. The position of the throttle in the remote drive mode, generally would not be that different from that of the throttle in the direct drive mode; therefore, only a slight change in throttle position results from first actuator movement. Cam surfaces 62 and 62' provide a gradual ramp so that no abrupt change in throttle position will occur when the first actuator is shifted.

In the event of an electrical malfunction, which may prevent stop movement, a manual coupling mechanism providing a mechanical actuated override stop may optionally be provided. Cable 40, which is shiftable by the vehicle occupant, provides a manual coupling means for coupling the accelerator pedal to the throttle valve in a specified relative orientation in response to a mechanical override signal provided by the occupant without any electrical actuation. Cable 40 is mechanically connected to the sun gear 48 at a point radially spaced from its center. Sun gear 48 is normally free to rotate due to the slack in cable 40. When the occupant of the vehicle wishes to manually enter the direct drive mode, cable 40 is pulled causing the slack to be taken up, as indicated by dotted line 70, rotating the sun gear to the fixed stop position. When cable 40 is returned to its slack position, as shown in FIG. 2, the sun gear once again is free to rotate constrained only by planet gear 52 and stop 64.

In the embodiments of the invention shown in the drawings, the sun gear acts as a control element, the planet carrier acts as drive element and the ring gear acts as a driven element. It should be appreciated that the ring gear can alternatively be used as the drive element and the planet carrier the driven element. Alternatively, the planet carrier could act as the control element and the sun and ring gears could form the drive and driven elements. The key feature in common to the various alternative arrangements is that the drive element is coupled to the accelerator pedal, the driven element coupled to the throttle valve and the control element engages both the drive and driven elements. The control element is free to move the drive and driven elements move independent from one another. When the control element is moved to a predetermined position, the drive and driven elements are oriented relative to one another at a predetermined position so that their movement is directly dependent upon one another.

FIG. 3 is a cross section of a compact throttle valve actuator 10 affixed to a throttle body assembly 12 illustrating how the device can be packaged commercially. Throttle body assembly 12 includes a body 74 having a throttle bore 18 extending therethrough. Throttle shaft 16 extends through throttle bore 18 and is oriented generally perpendicular thereto. Throttle blade 14 is affixed to throttle shaft 16 and is shown in the substantially closed position. Throttle shaft 16 is supported on a pair of bearings 76 affixed to body 74. A pair of seals 78 are affixed to the body 74 sealingly engaging the throttle shaft periphery. The throttle shaft 16 projects into the center of throttle valve actuator 10 and is affixed to rotor 44 of motor 42. The stationary portion of motor 42 is affixed to throttle body assembly 12 as shown.

Ring gear 46 is affixed to rotor 44 and extends circumaxially thereabout. Ring gear 46, as illustrated, is a gear segment attached to the rotor 44. With a single planet and a throttle valve which rotates approximately 90 degrees, a complete ring gear is not necessary. If multiple planets are used, a larger ring gear, would become necessary. Sun gear 48 and sun gear hub 56 are freely supported upon throttle shaft 16. Planet carrier 54 is fully supported on sun gear hub 56 and is coaxially aligned with throttle shaft 16. Planet shaft 80 is rotatably carried by planet carrier 54 radially spaced from the end and parallel to the throttle valve axis. Planet shaft 80 is provided with a large gear 50 and a small gear 52 cooperating with ring gear 46 and sun gear 48 respectively. Link 58 connects the planet carrier 54 to accelerator pedal input lever 24.

Sun gear hub 56 is provided with a pair of tangs 60 which engage the cam surfaces 62 and moveable stop 64. The moveable stop 64 is shifted axially between the remote drive position shown and a direct drive position in which the moveable stop 64 could be moved to the left in FIG. 3. The moveable stop is moved between the direct drive and remote drive modes by screw 66 coupled to the moveable stop motor 68. Belt 82 connect pulleys 84 and 86 coupled to motor 68 and screw 66 respectively.

In the preferred embodiment of the throttle valve actuator as shown in FIG. 3, an accelerator pedal position sensor 32 is provided having a plunger which follows the contour of planet carrier 54. The outer periphery of the planet carrier has an arcuate cam surface formed therein so that the accelerator pedal position sensor 32 can provide an input to controller 20.

Affixed to the end of the throttle shaft opposite the throttle valve actuator is a throttle position sensor 34. Throttle position sensor 34 can be any one of a number of conventional designs to provide an electrical input of throttle position to controller 20.

Figure 4:
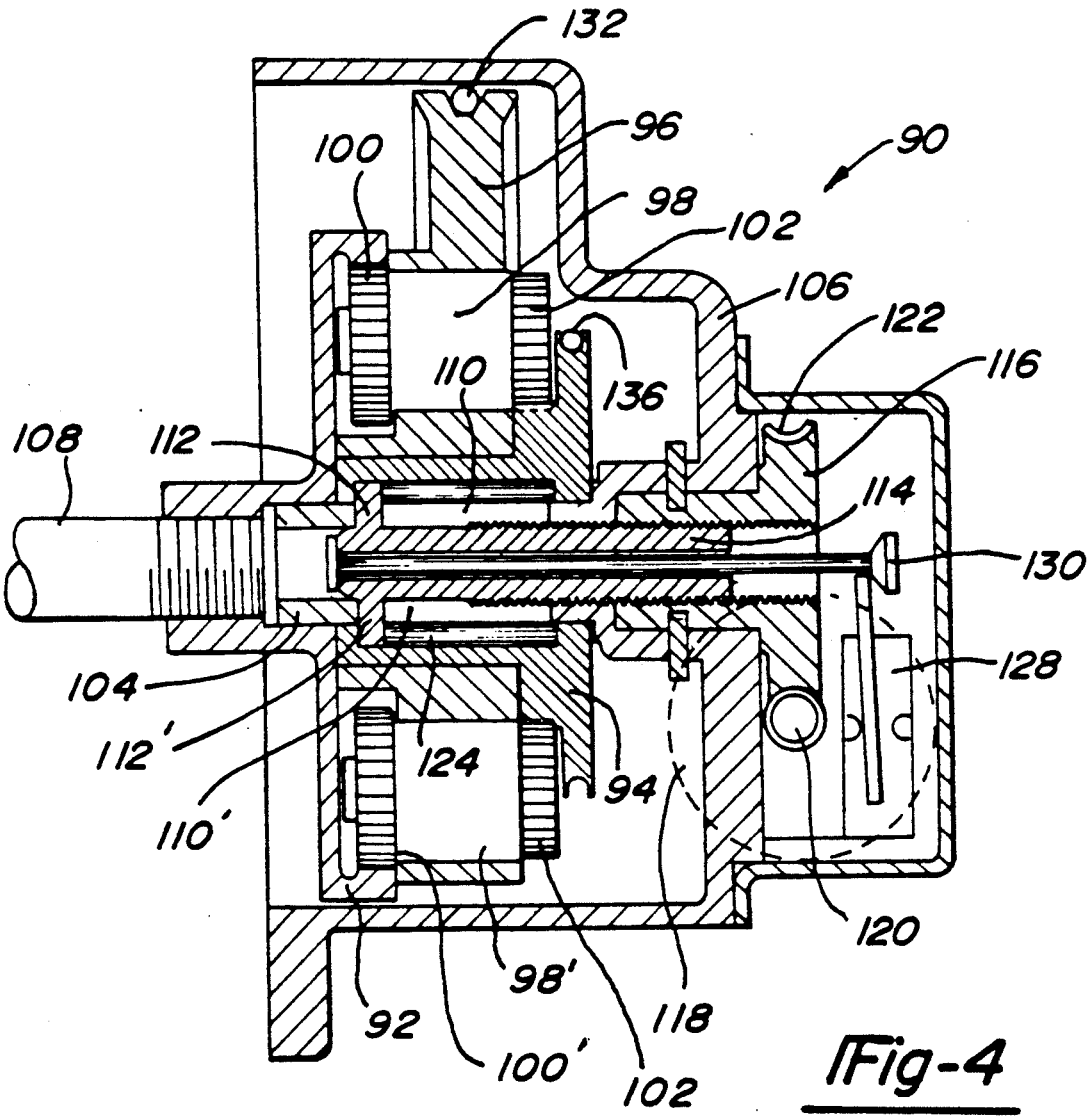
FIG. 4 is a cross-sectional side elevation of a second embodiment of the invention.

A second alternative embodiment 90 of the throttle valve actuator is shown in cross-sectional side elevation in FIG. 4. The throttle valve actuator housing 106 is affixed to the throttle body assembly in the manner described with reference to the first embodiment. Throttle valve actuator 90 includes a planetary gear set having a ring gear 92, a sun gear 94, planet carrier 96, and a pair of planets 98 and 98'. The planets are rotatably supported by a planet carrier and have gears 100 and 100' engaged with the ring gear 92 at one end thereof, and gears 102 and 102' engaged with the sun gear 94 at the other end.

Figure 5:
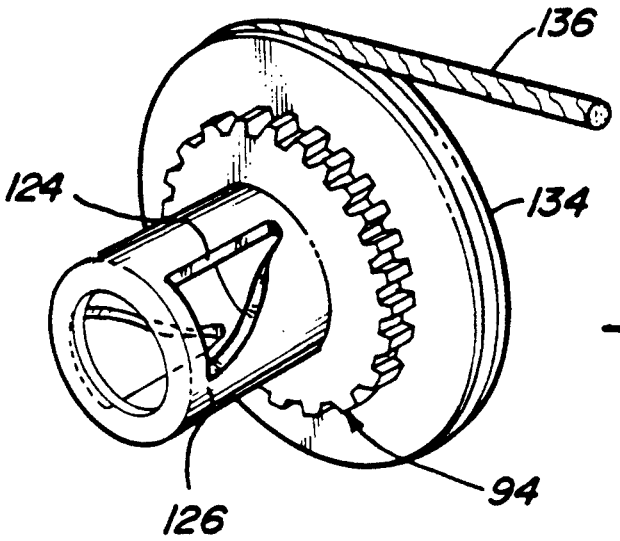
FIG. 5 is an enlarged perspective view of the sun gear hub shown in FIG. 4.

Unlike the first embodiment of the invention, wherein the sun gear is supported on a throttle shaft, in the second embodiment of the invention, the sun gear 94 is rotatably supported upon a tubular section 104 of housing 106. Tubular section 104 is coaxially aligned with throttle shaft 108 and is provided with a pair of slots 110 and 110' which slidably cooperate with tangs 112 and 112' formed on a stop screw 114. Stop screw 114 is prevented from rotating relative to the housing by tangs 112 and 112'. Stop screw 114 is shifted axially upon rotation of nut 116 by motor 118. A worm screw and gear, 120 and 122, are provided on the motor and nut respectively in order to drive the nut in either direction in response to a control signal. As shown in FIG. 5, Tangs 112 and 112' are a sufficient length to extend through housing tubular section 104 to engage a cam surface 124 within the hub 126 of the sun gear 94. By shifting the stop screw and the tangs affixed thereto axially, the sun gear can alternatively be free to rotate as shown in FIG. 4 or held in a fixed position relative to the housing as would occur when the stop screw is shifted axially to the right to the retracted position.

A limit switch 128 provides the means to sense the position of the screw in both the extended and retracted positions in order to limit the operation of actuator motor 118. When the screw is fully extended as shown, pin 130 engages the limit switch 128 to stop electrical motor 118. When the motor is driven to retract a screw, the screw will move until it engages the limit switch to again stop the electric motor.

The accelerator pedal is connected to the throttle valve actuator 90 by cable 132 which wraps about the outer periphery of planet carrier 96. In the direct drive mode, the movement of the planet carrier by the accelerator pedal causes the throttle shaft to move directly in the remote drive mode while the planet gear is free to rotate thereby uncoupling the planet carrier from the ring gear. In the remote drive mode, a motor which is not shown positions the throttle shaft to a control signal from the electronic engine controller previously described. The throttle motor may be affixed to the ring gear 92 in a manner similar to the first embodiment of the invention or the motor to be engaged to the throttle shaft at a different location.

The sun gear is provided with a pulley 134 that cooperates with a reset cable 136 which may be mechanically activated by the vehicle operator to manually couple the accelerator pedal to the throttle valve in a specified relative orientation in the event of a malfunction in the actuator motor 118. The second embodiment of the invention 90 otherwise functions substantially similar to throttle valve actuator 10.

Figure 6:
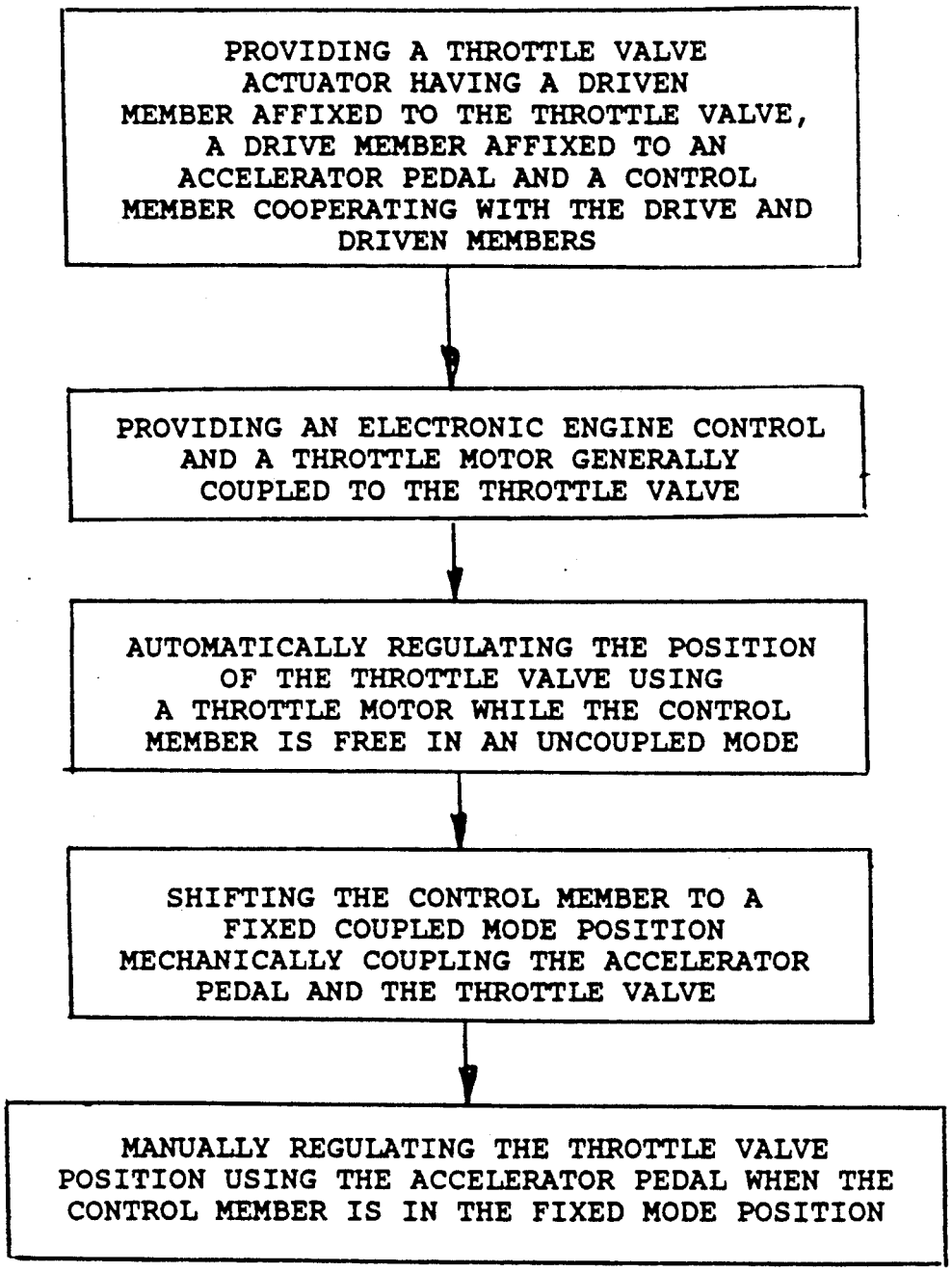
FIG. 6 is a flow chart illustrating a preferred embodiment of the method.

The method of automatically regulating the position of a throttle valve in a motor vehicle is illustrated in the flow chart FIG. 6. The first step of the method is to provide a throttle valve actuator having a driven member affixed to the throttle valve, a drive member affixed to the accelerator pedal of the vehicle, and a control member constantly cooperating with the drive and driven members. A throttle motor is provided which is controlled by an electronic engine controller. The throttle motor is redundantly coupled to the throttle valve to position same. The throttle valve actuator can be shifted between an uncoupled mode where the throttle valve and accelerator pedal are free to move relative to one another and the control member is free and a coupled mode where the control member is fixed and the drive and driven members are oriented in a predetermined relative position for movement in unison. The method includes the step of automatically regulating the position of the throttle valve using the throttle motor when the control member is in the uncoupled mode. The method further includes the step of shifting the control member to its fixed position in the coupled mode using a mechanically actuated override stop operable in the event of electrical malfunction thereby mechanically coupling the accelerator pedal and the throttle valve.

The method further includes a step of manually regulating the position of the throttle valve using the accelerator pedal. In the preferred embodiment of the method, the step of shifting the control member to its fixed position may be achieved either by automatically shifting the control member using a stop shiftable by an electric motor controlled by the electronic engine controller or, alternatively, shifting the control member to its fixed position using a mechanically activated override stop which can be operated in the event of an electrical malfunction rendering the remotely operable stop unusable.

It should also be understood of course that while the invention herein shown and described constitutes a preferred embodiment of the invention, it is not intended to illustrate all possible points thereof. Various alternative structures may be created by one of ordinary skill in the art without departing from the spirit and scope of the invention described in the following claims.

What is claimed is:

1. A throttle valve actuator for use in a motor vehicle having an electronic engine controller for connecting a throttle valve to a vehicle accelerator pedal linkage in either a direct or remote drive mode, the throttle valve actuator comprising:

a coupling for uncoupling and recoupling the throttle valve to the accelerator pedal linkage in a specified orientation, said coupling comprising a planetary gear set having a ring, a sun and a planet carrier which provides a drive element coupled to the accelerator pedal linkage, a driven element coupled to the throttle valve, and a control element alternatively free to rotate in the remote drive mode or fixed in a specified position in the direct drive mode;

a remotely operated stop means cooperating with the control element for positioning the control element in a specified fixed orientation in the direct drive mode and for releasing the control element when in the remote drive mode; and a remote drive mechanism cooperating with the engine controller for automatically positioning the throttle valve when in the remote drive mode to achieve a desired engine power output.

2. The throttle valve actuator of claim 1 further comprising an accelerator position sensor coupled to the drive element, and a throttle valve position sensor coupled to the driven element, to provide data inputs for the electronic engine controller.

3. The throttle valve actuator of claim 1 wherein said ring, sun and planet carrier respectively provide the driven element, control element and drive element.

4. The throttle valve actuator of claim 3 wherein said sun is rotatable about a central axis and is further provided with a locator boss radially spaced form said axis, for cooperating with said stop means to limit the rotation of the sun; said stop means shiftable axially relative to the sun between a remote drive position where the sun is free to rotate within a limited range and a direct drive position where the sun is fixed in a predetermined location.

5. The throttle valve actuator of claim 4 further comprising a reversible electric motor having a screw member rotatably coupled thereto, wherein the rotation of the screw drive electric motor causes the stop means to shift axially.

6. The throttle valve actuator of claim 4 wherein said stop means includes a pair of cam surfaces providing clockwise and counterclockwise stops for the sun locator boss, the circumaxial spacing of said cam surfaces gradually varying as a function of axial position in order to vary the range of motion of the sun as a function of a stop means position.

7. The throttle valve actuator of claim 6 wherein the throttle valve is free to rotate through its full range of motion when the stop means is in the remote drive position.

8. A method of automatically regulating the position of a throttle valve in a motor vehicle engine, comprising:

providing a throttle valve actuator having a driven member affixed to the throttle valve, a drive member affixed to the accelerator pedal of the vehicle, and a control member constantly cooperating with the drive and driven members, wherein the throttle valve and accelerator pedal are free to move relative to one another when the control member is free in an uncoupled mode, and are fixed relative to one another in a predetermined orientation when a control member is shifted to a fixed coupled mode position;

providing an electronic engine controller and a throttle motor controlled thereby which is redundantly coupled to the throttle valve for positioning same;

automatically regulating the position of the throttle valve using the throttle motor when the control member is in the uncoupled mode;

shifting the control member to the fixed coupled mode position when mechanical coupling of the accelerator pedal and the throttle valve is desired; and manually regulating the position of the throttle valve using the accelerator pedal when the control member is in the fixed coupled mode position.

9. The method of claim 8, wherein the step of shifting the control member to its fixed coupled mode position further comprises shifting a stop means regulated by the electronic engine controller into engagement with the control member for positioning the control member in a predetermined fixed position.

10. The method of claim 8, wherein the throttle valve actuator drive, driven and controlled members respectively form a planet carrier, a ring and sun of a planetary gear set, and said step for shifting the control member further comprising rotating the sun gear to a predetermined fixed location, thereby directly coupling the planet carrier to the ring.

11. The method of claim 10, wherein the step of shifting the control member to its fixed coupled mode position further comprises shifting a stop means regulated by the electronic engine controller into engagement with the control member for positioning the control member in a predetermined fixed position.

12. The method of claim 11, wherein the step of shifting the control member to the fixed position is achieved by axially shifting the stop means using a screw member driven by a reversible electric motor.

13. The method of claim 8, further comprising the step of manually shifting the control member to the fixed position utilizing a mechanically activated override stop operable in the event of an electrical malfunction to directly couple the throttle valve to the accelerator pedal.

14. The method of claim 10, further comprising the step of manually shifting the control member to the fixed position utilizing a mechanically activated override stop operable in the event of an electrical malfunction to directly couple the throttle valve to the accelerator pedal.

15. A motor vehicle throttle valve actuator for use in a vehicle having an electronic engine controller to connect the engine throttle valve to the vehicle accelerator pedal linkage in either a direct or remote drive mode, said throttle valve actuator comprising:

automatic coupling means for uncoupling and recoupling the throttle valve to the accelerator pedal linkage in a specified relative orientation in response to a coupling signal;

remote drive means for automatically positioning the throttle valve when uncoupled from the accelerator pedal linkage in response to a control signal from the electronic engine controller; and manual coupling means for coupling the accelerator pedal to the throttle valve in said specified relative orientation in response to a mechanical override signal provided without any electrical actuation.

16. The throttle valve actuator of claim 15 wherein said automatic coupling means further comprises a remotely operable stop, a drive element coupled to the accelerator pedal linkage, a driven element coupled to the throttle valve and a control element cooperating with the drive and driven elements, said control element being alternatively free to move allowing the drive and driven elements to move independently of one another, or fixed in a predetermined orientation by said stop causing the drive and driven elements to move dependently with one another.

17. The throttle valve actuator of claim 16 wherein said driven element, drive element and control element, form the ring, sun and planet carrier of a planetary gear set.

18. The throttle valve actuator of claim 17 wherein said sun is rotatable about a central axis and is further provided with a locator boss radially spaced from said axis for cooperating with said stop means to limit the rotation of the sun; said stop means shiftable axially relative to the sun between a remote drive position where the sun is free to rotate within a limited range and a direct drive position where the sun is fixed in a predetermined location.

19. The throttle valve actuator of claim 17 wherein said manual coupling means further comprises a cable affixed to the sun gear allowing the sun to rotate when the cable is slack and rotating the sun to and retaining the sun in a fixed position when the cable is pulled taut.

20. The throttle valve actuator of claim 15 wherein the remote drive means further comprises an electric motor affixed to the throttle valve which exerts a positioning force thereon which is sufficiently weak so that, when the manual coupling means connects the throttle valve to the accelerator pedal, the movement of the accelerator pedal controls throttle position irrespectively of the electronic engine controller.

* * * * *